US006930575B2

(12) United States Patent
Azzola et al.

(10) Patent No.: US 6,930,575 B2
(45) Date of Patent: Aug. 16, 2005

(54) ELECTROMAGNETIC RELAY FOR LOW-VOLTAGE CIRCUIT BREAKER

(75) Inventors: Lucio Azzola, Bergamo (IT); Stefano Besana, Milan (IT)

(73) Assignee: ABB Service S.R.L., Milan (IT)

( * ) Notice: Subject to any disclaimer, the term of this patent is extended or adjusted under 35 U.S.C. 154(b) by 0 days.

(21) Appl. No.: 10/496,838

(22) PCT Filed: Dec. 16, 2002

(86) PCT No.: PCT/EP02/14405

§ 371 (c)(1),
(2), (4) Date: May 27, 2004

(87) PCT Pub. No.: WO03/054898

PCT Pub. Date: Jul. 3, 2003

(65) Prior Publication Data

US 2005/0007220 A1 Jan. 13, 2005

(30) Foreign Application Priority Data

Dec. 20, 2001 (IT) ..... MI2001A2717

(51) Int. Cl.[7] ..... H01H 9/00
(52) U.S. Cl. ..... 335/42; 335/35; 335/176
(58) Field of Search ..... 335/23–25, 35–42, 335/165–176

(56) References Cited

U.S. PATENT DOCUMENTS 3,421,123 A * 1/1969 Johnson et al. ..... 335/35
4,706,054 A * 11/1987 Hampton et al. ..... 335/203

FOREIGN PATENT DOCUMENTS

| | | |
|---|---|---|
| DE | 295 15 254 U1 | 12/1995 |
| EP | 0 326 449 A1 | 8/1989 |
| EP | 0 369 899 A1 | 5/1990 |

* cited by examiner

*Primary Examiner*—Lincoln Donovan
(74) *Attorney, Agent, or Firm*—Connolly Bove Lodge & Hutz LLP; Myron K. Wyche

(57) ABSTRACT

An electromagnetic relay with adjustable tripping threshold for a low-voltage circuit breaker, comprising a magnetic circuit that has a fixed part,, which comprises a fixed element made of ferromagnetic material, a core, and at least one winding coil, and a moving part, which has a moving plate made of ferromagnetic material and arranged so as to face at least partially the fixed element with the coil interposed between the moving plate and the fixed element, the moving plate being functionally connected to means for adjusting the tripping threshold; its particularity consisting of the fact that the moving plate and/or the fixed element have a contoured body that allows, by acting on the adjustment means, to set the tripping threshold by simultaneously varying the gap between the moving plate and the fixed element and the magnetic coupling between the moving plate and the core.

11 Claims, 3 Drawing Sheets

ELECTROMAGNETIC RELAY FOR LOW-VOLTAGE CIRCUIT BREAKER

CROSS-REFERENCE TO RELATED APPLICATIONS

This application is a National Phase Application under 35 U.S.C. Section 371 of PCT/EP02/14405, filed Dec. 16, 2002.

The present invention relates to an electromagnetic relay for a low-voltage circuit breaker, i.e., for applications with operating voltages up to 1000 V, having improved characteristics.

More particularly, the present invention relates to an electromagnetic relay, of the type with adjustable tripping threshold and high field gradient, which has, with respect to the known type of relay, a wider and more linear adjustment range.

BACKGROUND OF THE INVENTION

It is known that low-voltage electrical systems, particularly for industrial-type applications, characterized by operating voltages lower than 1000 volts and by electric currents of relatively high nominal value producing considerable power levels, generally use current interruption and protection devices, known as automatic power circuit breakers.

Depending on the applications, these devices comprise one or more electric poles that constitute the interruption section of the circuit breaker; each pole comprises at least one arc chute and two electrical contacts, a fixed one and a moving one, which can be mutually coupled/uncoupled; in turn, the contacts are connected electrically to the phase or neutral conductor associated with said pole by virtue of suitable connection terminals.

Each electrical pole, moreover, is provided with a suitable current sensor, normally constituted either by a current sensing transformer, whose primary winding is constituted by the conductor to which said pole is connected, or by a magnetic relay whose winding coil is again constituted by said conductor.

These magnetic relays can be considered essentially as two-stage transducers, i.e., transducers capable of converting initially the electric energy into magnetic energy and then the magnetic energy into mechanical energy. The sensitive part of a magnetic relay in fact comprises an electromagnet that has a plate made of ferromagnetic material, which subjects a suitable lever system to mechanical actions that depend on the value of the magnetic field generated by the electromagnet; said magnetic field in turn depends on the intensity of the current that circulates in the corresponding electrical conductor. The mechanical actions produced in the lever system are then appropriately directed in input to a protection unit, which causes the safety release or opening of the circuit breaker.

Currently, the magnetic relays used in low-voltage circuit breakers can be of the fixed or adjustable type, the latter being the case of the present invention. In the specific case, adjustable relays allow to set the tripping threshold of the protection unit of the circuit breaker over a given range; in the current art, the methods by which the tripping threshold is adjusted allow to obtain devices that can perform their required functions adequately but have some critical aspects.

In particular, the threshold of magnetic relays is set by using suitable adjustment means, by acting on the magnetic circuit of the relay itself, which is substantially constituted by two parts: a fixed part, which comprises a ferromagnetic element, a core and a coil, and a moving part, which comprises a plate that is also made of ferromagnetic material.

There are substantially two known solutions used to adjust the tripping threshold; these solutions utilize separately two different physical phenomena: a first solution, commonly known as gap variation, entails acting on the geometric distance between the moving plate and the core; the second solution, commonly known as magnetic coupling variation, instead entails acting on the parallel sliding between the moving magnetic plate and the fixed part. In both cases, the adjustment consists in gradually modifying the relative position of the ferromagnetic plate of the moving part and the fixed part of the electromagnet, increasing or reducing the efficiency of the conversion of the magnetic energy generated by the electromagnet into mechanical energy induced in the lever system that actuates the safety release or opening device of the circuit breaker.

One of the main drawbacks of the known art arises from the fact that with these solutions the response to modifications made to the magnetic circuit is not sufficiently uniform, because identical variations in the configuration of the magnetic circuit are matched by non-uniform increases in the various stages of the adjustment range; in other words, the sensitivity of the relay tends to vary in a nonlinear fashion over the adjustment range, exhibiting a gradual degradation of reliability especially in the extreme regions of the adjustment range.

It is this last aspect in particular that leads, in common practice, to a forced limitation of the useful setting range and has a particularly negative impact especially in applications in compact circuit breakers, where limited spaces for accommodating the relays require great miniaturization, making this limitation even more significant.

Finally, since a circuit breaker is normally set by acting on multiple relays by means of a single actuation element, slight differences in movement at the level of the simultaneous adjustment devices can lead to significant imbalances in the setting among the relays of each pole and cause non-uniform tripping of the protection device.

BRIEF SUMMARY OF THE INVENTION

The aim of the present invention is to provide an electromagnetic relay with adjustable tripping threshold for a low-voltage circuit breaker that allows to obviate the drawbacks described above and in particular allows an extremely effective and optimized setting of the tripping threshold with respect to known types of adjustable relay.

Within the scope of this aim, a first object of the present invention is to provide an electromagnetic relay with adjustable tripping threshold for a low-voltage circuit breaker that allows to extend considerably the useful adjustment range of the tripping threshold even in compact relays.

Another object of the present invention is to provide an electromagnetic relay with adjustable tripping threshold for a low-voltage circuit breaker that allows to obtain, in a simple and reliable manner, an extremely precise and uniform response in setting the tripping threshold.

Another object of the present invention is to provide an electromagnetic relay with adjustable tripping threshold for a low-voltage circuit breaker that has a reduced number of parts and a high degree of reliability, with improved functional performance.

Another object of the present invention is to provide an electromagnetic relay with adjustable tripping threshold for a low-voltage circuit breaker that is easy to manufacture and at modest costs.

This aim, these objects and others that will become better apparent hereinafter are achieved by an electromagnetic relay with adjustable tripping threshold for a low-voltage circuit breaker, comprising a magnetic circuit that has a fixed part, which comprises a fixed element made of ferromagnetic material, a core, and at least one winding coil, and a moving part, which has a moving plate made of ferromagnetic material and arranged so as to face at least partially said fixed element with the coil interposed between said moving plate and said fixed element, said moving plate being functionally connected to means for adjusting the tripping threshold;

characterized in that said moving plate and/or said fixed element have a contoured body that allows, by acting on said adjustment means, to set the tripping threshold by simultaneously varying the gap between the moving plate and the fixed element and the magnetic coupling between said moving plate and the core.

Advantageously, the magnetic relay according to the invention has a geometry that allows to utilize simultaneously the different effect of multiple physical phenomena occurring in different regions of the magnetic circuit, i.e., the variation of the gap and of the magnetic coupling, allowing to obtain, with respect to known relays, a considerable extension of the adjustment range of the tripping threshold with great precision and reliability of behavior within the adjustment range.

BRIEF DESCRIPTION OF THE SEVERAL VIEWS OF THE DRAWINGS

Further characteristics and advantages of the invention will become better apparent from the description of a preferred but not exclusive embodiment of the relay according to the present invention, illustrated only by way of non-limitative example in the accompanying drawings, wherein.

DETAILED DESCRIPTION OF THE INVENTION

Figure 4:
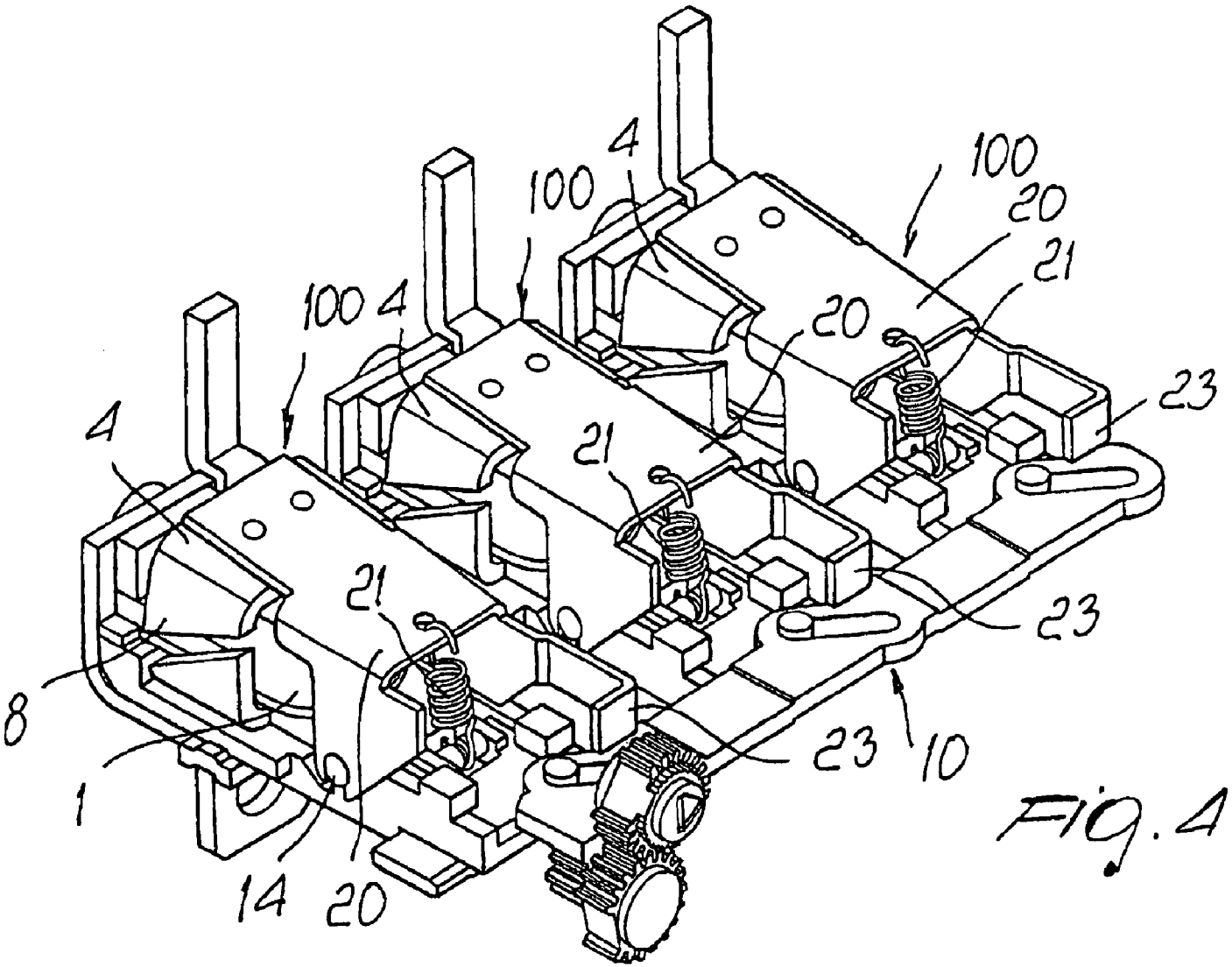
FIG. 4 is a perspective view of three magnetic relays according to the invention, coupled to a single system for adjusting the tripping threshold.

With reference to the cited figures, the magnetic relay with adjustable tripping threshold for a low-voltage circuit breaker, generally designated by the reference numeral 100, comprise a magnetic circuit that has a fixed part, which comprises at lest one coil 1, one magnetic core 2 and one fixed element 3, made of ferromagnetic material, typically a ferromagnetic plate, and a moving part, which is provided with a moving plate 4 also made of ferromagnetic material, which is functionally connected to tripping threshold adjustment means. Said adjustment means, designated by the reference numeral 10 by way of example in FIG. 4, comprise, according to the requirements and/or needs of the application, a rack system or a slider or a screw or a knob et cetera.

Advantageously, in the embodiment of the relay 100 according to the invention, the moving plate 4 and/or the fixed element 3 have a contoured body that allows, by acting on said adjustment means 10, to set the tripping threshold by simultaneously varying the gap between the moving plate 4 and the fixed element 3 and the magnetic coupling between said moving plate 4 and the core 2.

Preferably, in the relay 100 according to the invention, the moving plate 4 has a contoured body that allows, during the setting of the tripping threshold, a simultaneous variation of the gap and of the magnetic coupling; in turn, the fixed element 3 has a contoured body that allows, during the setting of the tripping threshold, a variation of the gap, interacting in doing so with the contoured body of the moving plate 4, as detailed in the description that follows.

In particular, as shown in FIGS. 1 to 4, the moving plate 4 has a substantially U-shaped body that is arranged, during the assembly of the various parts of the relay, so that its concavity is directed toward the fixed element 3, so that at least part of its surface faces the surface of said element 3 and the coil 1 and the core 2 are interposed between them.

Figure 1:
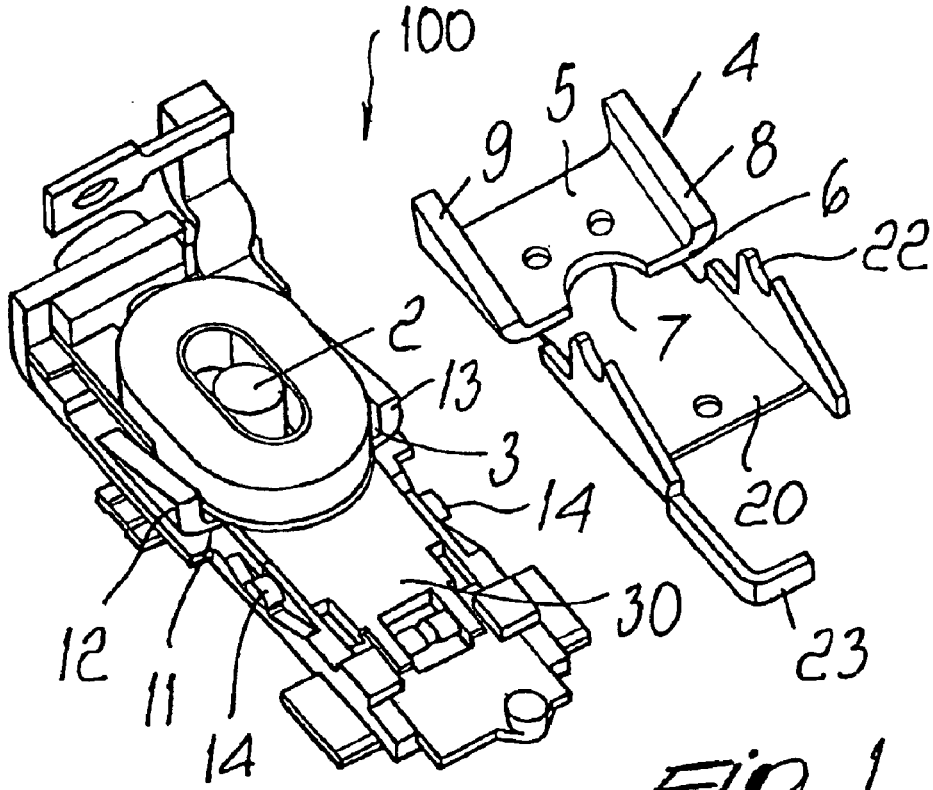
FIG. 1 is an exploded perspective view of the fixed part and of the moving plate of the relay according to the invention, shown uncoupled from each other.

As shown in detail in FIG. 1, the central portion 5 of the U-shaped body has, along the edge 6 arranged at the core 2, a recessed portion 7; preferably, said recessed portion 7 has a contoured profile that is geometrically complementary with respect to the profile of the core 2. In this manner, the mutual geometry between said portion 7 and the core 2 allows to optimize the linearity in the adjustment field. In the specific case shown in the figures, the portion 7 preferably has a curved profile; as an alternative, depending on the specific requirements of application and/or on the shape of the profile of the core 2, the recessed portion 7 might be shaped differently, so long as it is shaped in a manner that is compatible with the application. Furthermore, at least one of the two lateral arms, respectively 8 and 9, of said U-shaped body has, in a side view, a substantially oblique profile. Advantageously, in the embodiment of the relay 100 according to the invention, both lateral arms 8 and 9 of the U-shaped body have an oblique profile.

In the illustrated embodiment, the moving plate 4 is connected to an additional contoured plate 20 made of non-ferromagnetic material; said plate 20 is connected in a movable manner to an additional component 30 that is rigidly coupled to the fixed element 3 by virtue of a spring 21 and two engagement elements 22 that are coupled to corresponding pivots 14 formed on said element 30. Finally, the plate 20 is provided with a contoured end 23 that is suitable to interact functionally with release means (not shown) of the circuit breaker.

In turn, the fixed element 3 has a substantially flat central portion 11 at which the coil 1 and the core 2 are arranged, and preferably has two lateral wings 12 and 13 that protrude transversely from the flat central portion 11, at the sides of the coil 1. Advantageously, at least one of the two wings 12 and 13 has, in side view, a substantially oblique profile; preferably, both wings 12 and 13 of the fixed element 3 have oblique profiles. Said profiles, as shown in FIG. 2, are arranged so that each one faces a corresponding oblique profile of the moving plate 4 and is substantially parallel thereto.

Figure 2:
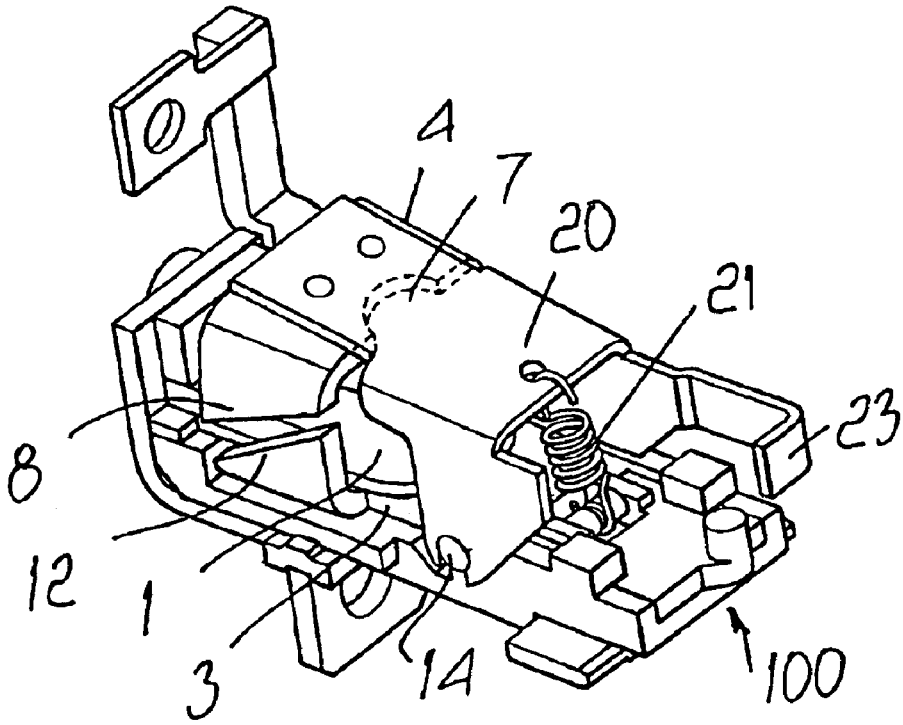
FIG. 2 is a perspective view of the relay of FIG. 1, with the fixed part and the moving part mutually assembled.
Figure 3:
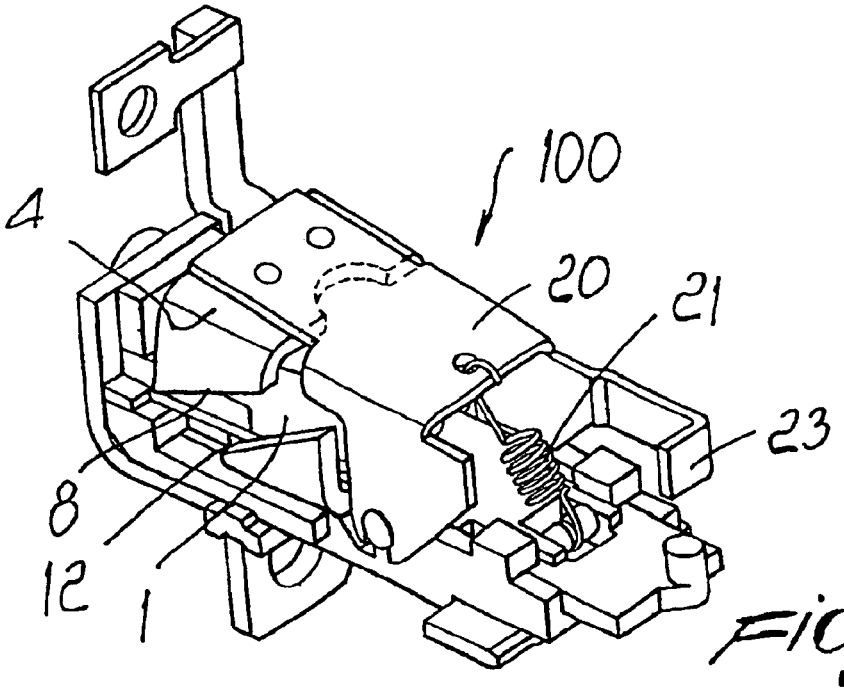
FIG. 3 is a perspective view of the relay of FIG. 2 in a different state of threshold adjustment.

In practice, during the adjustment of the tripping threshold, the action on the adjustment means causes the sliding, on a substantially horizontal plane, of the moving plate 4 with respect to the fixed element 3; accordingly, the moving plate 4 passes for example from an initial position, shown in FIG. 2, to a final position, shown in FIG. 3. In this manner, by virtue of the presence of the recessed portion 7, there is a variation in the magnetic coupling that occurs between said moving plate 4 and the magnetic core 2; moreover, at the same time the oblique arms 8 and 9 of the plate 4 move away from the corresponding oblique profiles of the wings 12 and 13, and this allows to increase the gap.

Figure 5:
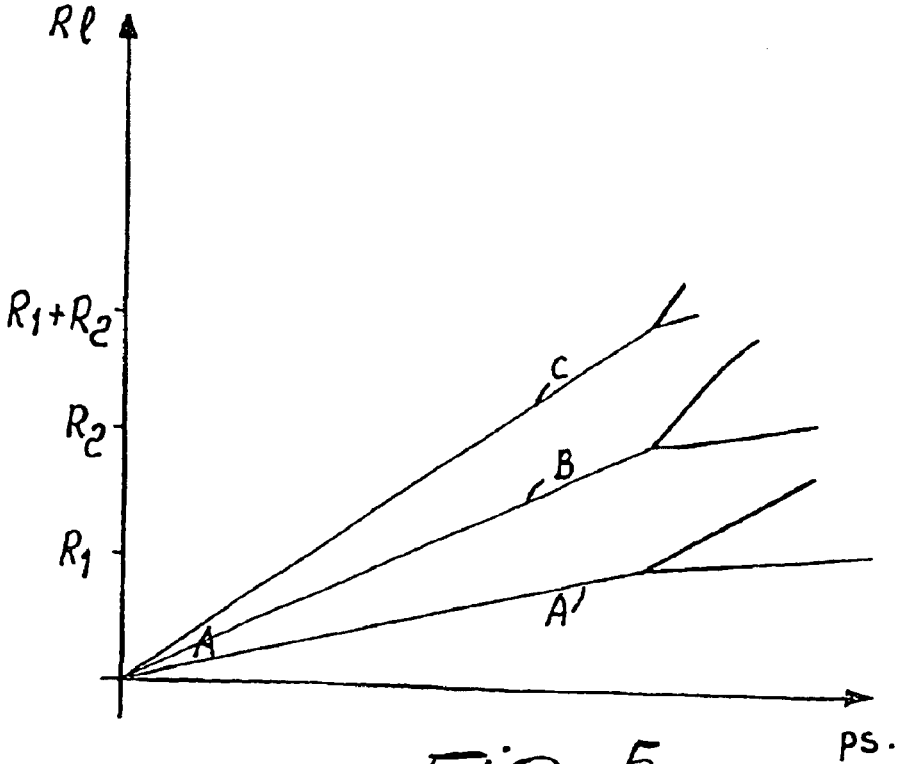
FIG. 5 is a qualitative chart that compares magnetic reluctance as a function of the movement of the moving plate in the relay according to the invention with respect to known types of relay that utilize the threshold adjustment solutions separately.

In this manner, the variations of the gap and of the coupling of the magnetic circuit of the relay are utilized simultaneously and in an advantageously synergistic manner, and this allows to achieve, with respect to known types of solution, higher values of magnetic reluctance in a substantially linear condition; this is shown qualitatively in FIG. 5, which plots schematically the magnetic reluctance as a function of the position of the moving part, respectively, in the case of a relay in which threshold adjustment occurs only by varying the gap (curve A), only by varying the magnetic coupling (curve B), and in the relay 100 according to the invention (curve C).

Ultimately, this allows to obtain, by virtue of the suitably calibrated overlap of the above cited effects, an extremely effective and linear response, with increased reliability of the magnetic adjustment and an extension of the useful adjustment range of the threshold beyond which the circuit breaker protection unit is required to trip.

The relay 100 according to the invention is particularly suitable for use, individually or in combination with additional relays 100, in an automatic low-voltage power circuit breaker, be it of the standard, current-limiting, single-pole or multiple-pole types, with single or double contacts for each pole, et cetera. Accordingly, another aspect of the present invention is constituted by an automatic power circuit breaker, characterized in that it comprises at least one electromagnetic relay 100 of the type described above.

In practice it has been found that the relay according to the invention allows to achieve the intended aim and objects, providing a series of significant advantages with respect to the relays of the known art. In addition to the advantages described above, it should also be noted that the relay can be produced cheaply and is characterized by very easy practical use; moreover, within the tripping threshold it has improved reliability and great precision, which can also be observed in applications using highly miniaturized relays or using multiple relays adjusted simultaneously by means of a single device, as shown for example in FIG. 4.

The relay thus conceived is susceptible of numerous modifications and variations, all of which are within the scope of the inventive concept. Thus, for example, the lateral arms of the moving plate 4 and/or the wings of the fixed element 3 might have an oblique profile that is not perfectly straight and is for example slightly arc-like. Furthermore, the materials used, so long as they are compatible with the specific use, as well as the contingent shapes and dimensions, may be any according to the requirements and the state of the art.

What is claimed is:

1. An electromagnetic relay with adjustable tripping threshold for a low-voltage circuit breaker, comprising:

a magnetic circuit that has a fixed part, which comprises a fixed element made of ferromagnetic material, a core, and at least one winding coil; and a moving part, which has a moving plate made of ferromagnetic material and arranged so as to face, at least partially, said fixed element with the coil interposed between said moving part and said fixed element, wherein said moving part is connected to means for adjusting the tripping threshold; and said moving plate and/or said filed element have a contoured body that allows, by acting on said adjustment means, setting of the tripping threshold by simultaneously varying the gap between the moving plate and the fixed element and the magnetic coupling between said moving plate and the core.

2. The electromagnetic relay according to claim 1, characterized in that said moving plate has a contoured body that allows to simultaneously vary the gap and the magnetic coupling during the setting of the tripping threshold.

3. The electromagnetic relay according to claim 1, characterized in that said fixed element has a contoured body that allows to vary the gap during the setting of the tripping threshold.

4. The electromagnetic relay according to claim 1, characterized in that said moving plate is arranged, with respect to said fixed element, in a manner that can be adjusted by sliding on a substantially horizontal plane.

5. The electromagnetic relay according to claim 1, characterized in that said moving plate has a substantially U-shaped body that is arranged so that its concavity is directed toward said fixed element, the central portion of said U-shaped body having a recessed portion along the edge arranged at the core.

6. The electromagnetic relay according to claim 5, characterized in that said recessed portion has a profile that is geometrically complementary to the profile of the core.

7. The electromagnetic relay according to claim 5, characterized in that at least one lateral arm of said U-shaped body has a substantially oblique profile.

8. The electromagnetic relay according to claim 7, characterized in that both lateral arms of said U-shaped body have a substantially oblique profile.

9. The electromagnetic relay according to claim 1, characterized in that said fixed element has a substantially flat central portion, at which the coil and the core are located, and two lateral wings, which protrude transversely from the flat central portion at the sides of the coil, at least one of said two wings having an oblique profile.

10. The electromagnetic relay according to claim 9, characterized in that both wings of said fixed element have oblique profiles, each of which faces a corresponding oblique profile of the moving plate.

11. An automatic power circuit breaker, characterized in that it comprises at least one electromagnetic relay according to claim 1.

* * * * *